US008529018B2

(12) United States Patent
Takeuchi et al.

(10) Patent No.: US 8,529,018 B2
(45) Date of Patent: Sep. 10, 2013

(54) RECORDING APPARATUS

(75) Inventors: Toshiki Takeuchi, Yokohama (JP); Nobuhiro Toki, Kawasaki (JP); Haruo Uchida, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/413,503

(22) Filed: Mar. 6, 2012

(65) Prior Publication Data

US 2012/0162296 A1 Jun. 28, 2012

Related U.S. Application Data

(63) Continuation of application No. 12/540,833, filed on Aug. 13, 2009, now Pat. No. 8,152,269.

(30) Foreign Application Priority Data

Aug. 21, 2008 (JP) ..... 2008-212969

(51) Int. Cl.
*B41J 2/165* (2006.01)

(52) U.S. Cl.
USPC ..... 347/34

(58) Field of Classification Search
USPC ..... 347/32
See application file for complete search history.

(56) References Cited

U.S. PATENT DOCUMENTS 8,152,269 B2 * 4/2012 Takeuchi et al. ..... 347/32

FOREIGN PATENT DOCUMENTS

JP 2006315267 A 11/2006

* cited by examiner

*Primary Examiner* — Julian Huffman
(74) *Attorney, Agent, or Firm* — Canon U.S.A., Inc. IP Division

(57) ABSTRACT

A recording apparatus includes a carriage carrying a recording head and being movably supported, the recording head being configured to eject liquid onto a recording medium, a plurality of driven units to be driven by a drive source that generates a driving force, a transmission-switching mechanism configured to switch between the driven units, a carriage locker configured to prevent and allow movement of the carriage, and a transmission-switching locker configured to prevent and allow switching between the driven units. Movement prevention by the carriage locker and switching prevention by the transmission-switching locker are in synchronicity, and movement allowance by the carriage locker and switching allowance by the transmission-switching locker are in synchronicity.

11 Claims, 12 Drawing Sheets

RECORDING APPARATUS

CROSS-REFERENCE TO RELATED APPLICATIONS

This application is a continuation of U.S. patent application Ser. No. 12/540,833, filed Aug. 13, 2009, which claims the benefit of Japanese Application No. 2008-212969, filed Aug. 21, 2008, both of which are hereby incorporated by reference herein in their entirety.

BACKGROUND OF THE INVENTION

1. Field of the Invention

The present invention relates to recording apparatuses such as a copier and an inkjet printer.

2. Description of the Related Art

Recent inkjet recording apparatuses are configured such that multiple operations, including feeding and conveyance of recording media and recovery of recording heads, are performed with fewer drive sources, for reduction of the manufacturing cost and space saving. In this respect, such a recording apparatus includes a transmission-switching mechanism configured to switch between a plurality of driven units to be driven by a driving force from a drive source.

Such a transmission-switching mechanism performs switching between driven units by utilizing a drive source that provides a driving force to the transmission-switching mechanism, and another mechanism that receives a driving force from another drive source. An example is disclosed in Japanese Patent Laid-Open No. 2005-330105, in which movement of a carriage, corresponding to the another mechanism, is utilized for switching between driven units.

In general, a recording apparatus includes a carriage that is movable while carrying a recording head configured to perform recording on a recording medium by ejecting liquid, such as ink on to the medium.

In the apparatus disclosed in Japanese Patent Laid-Open No. 2005-330105, switching (shifting) between units to be driven by a drive source is realized by utilizing movement of the carriage. Specifically, the carriage engages with a restricting member provided on a swing arm and can cause a gear provided on the swing arm to slide. Thus, the gear on the swing arm can separated from any of a plurality of trains of gears (this state is hereinafter referred to as the "neutral state"). The trains of gears are connected to different driven units.

In the neutral state, when a driving force is provided by the drive source, the swing arm rotates and moves. With this rotation, the gear on the swing arm can be moved to an intended one of the trains of gears. When the carriage is subsequently moved again, the gear on the swing arm slides in the opposite direction, thereby meshing with another train of gears. Thus, transmission of the driving force from the drive source can be switched between different driven units.

In the apparatus disclosed in Japanese Patent Laid-Open No. 2005-330105, however, there is a possibility of malfunction of and damage to the transmission-switching mechanism caused during transportation of the apparatus or by significant vibration and impact. In some cases, repeated meshing and unmeshing of gears may damage the apparatus. In other cases, meshing of a gear with an unintended train of gears may cause malfunction while the apparatus is in operation (or when the apparatus is turned on).

The occurrence of malfunction of and damage to the transmission-switching mechanism can be suppressed if switching between driven units is regulated. Known methods of regulating the switching operation performed by the transmission-switching mechanism include methods utilizing an electromagnetic lock, a locking member, and a spring.

If movement of the carriage is utilized for switching between driven units, regulating the movement of the carriage is also advantageous in suppressing the occurrence of malfunction of and damage to the transmission-switching mechanism. An exemplary configuration that regulates movement of the carriage is disclosed in Japanese Patent Laid-Open No. 2002-36604. In this example, a lock lever projects into a carriage movement area so as to fix the position of the carriage.

If the transmission-switching mechanism that regulates switching between driven units is combined with the recording apparatus, including the lock lever, disclosed in Japanese Patent Laid-Open No. 2002-36604, the number of components increases, resulting in problematically complicated configuration and control method.

Moreover, since the regulation of movement of the carriage and the regulation of switching between driven units by the transmission-switching mechanism are performed independently, there still remains a possibility of malfunction of and damage to the transmission-switching mechanism caused during transportation of the apparatus or by significant vibration and impact. Such a problem tends to be noticeable in a case where the regulation of movement of the carriage is performed frequently.

SUMMARY OF THE INVENTION

The present invention provides a recording apparatus capable of solving at least one of the problems described above. For example, the present invention provides a recording apparatus in which the occurrence of malfunction of and damage to a transmission-switching mechanism that switches between driven units is suppressed.

To solve at least one of the above problems, an aspect of the present invention provides a recording apparatus including a carriage carrying a recording head and being movably supported, the recording head being configured to eject liquid onto a recording medium, a plurality of driven units to be driven by a drive source that generates a driving force, a transmission-switching mechanism configured to switch between the driven units, a carriage locker configured to prevent and allow movement of the carriage, and a transmission-switching locker configured to prevent and allow switching between the driven units. Movement prevention by the carriage locker and switching prevention by the transmission-switching locker are in synchronicity, and movement allowance by the carriage locker and switching allowance by the transmission-switching locker are in synchronicity.

Thus, the occurrence of malfunction of and damage to the transmission-switching mechanism that switches between the driven units is suppressed.

Further features of the present invention will become apparent from the following description of exemplary embodiments with reference to the attached drawings.

DESCRIPTION OF THE EMBODIMENTS

Embodiments of the present invention will now be described with reference to the drawings.

The following embodiments each concern an inkjet recording apparatus that handles recording media such as recording paper and cassettes. However, the present invention is applicable to various recording apparatuses that perform recording on flat recording media such as plastic sheets and recording discs, as well as recording paper and cassettes.

Figure 1:
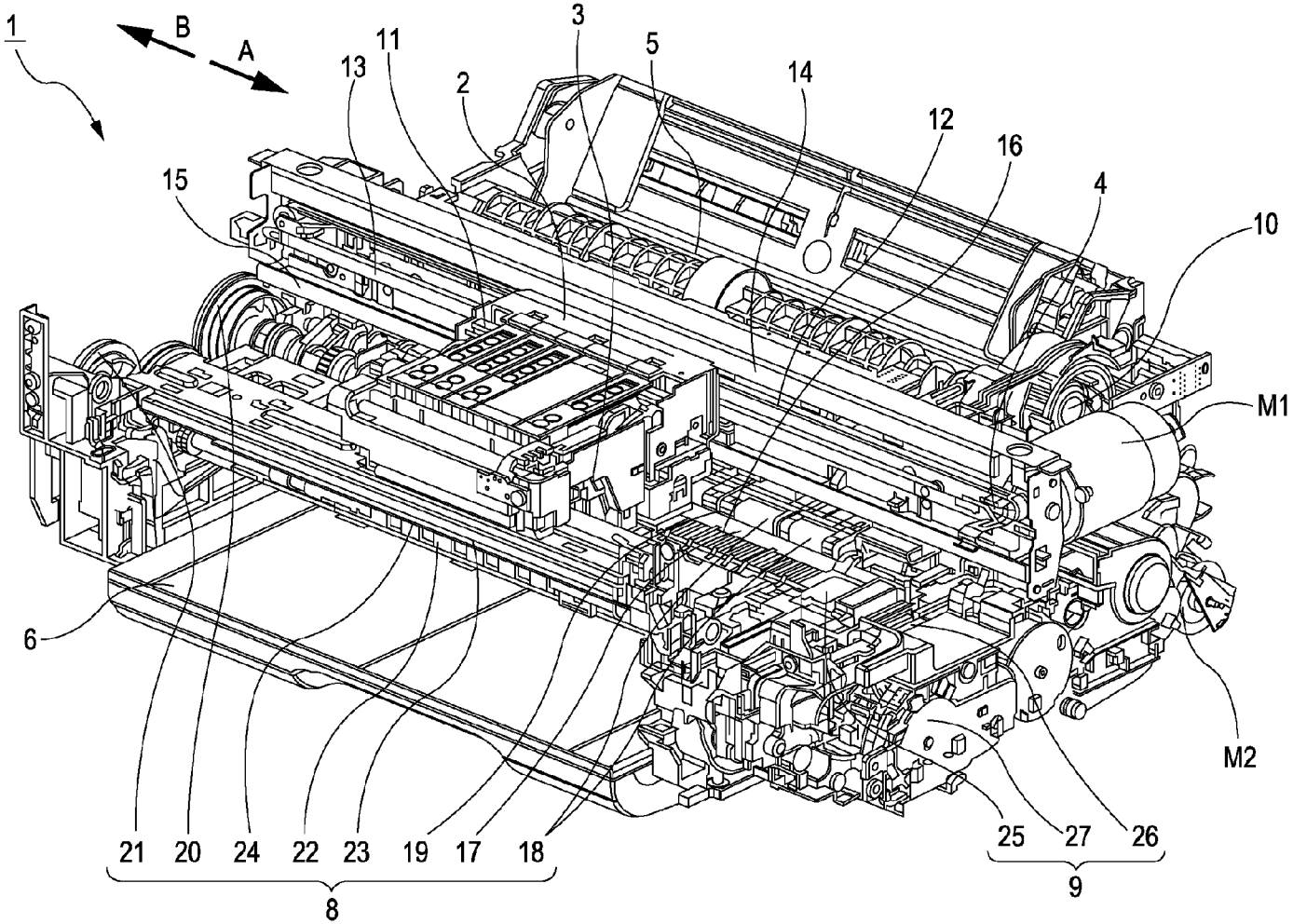
FIG. 1 is a schematic perspective view of a recording apparatus according to an exemplary embodiment of the present invention.

FIG. 1 is a schematic perspective view of a recording apparatus according to an exemplary embodiment of the present invention.

A recording apparatus 1 includes a carriage 2 movably supported and carrying a recording head 3, a feed mechanism 5, a cassette-feed mechanism 6, a conveyance mechanism 8, and a recovery unit 9.

The recording head 3 serves as a recording unit configured to perform recording on a recording medium by ejecting liquid, such as ink, onto the recording medium. The feed mechanism 5 feeds a recording medium such as recording paper or a sheet to an area in which the liquid is ejected from the recording head 3 (hereinafter also referred to as the "recording area"). The cassette-feed mechanism 6 feeds a recording medium such as plain paper to the recording area. The conveyance mechanism 8 conveys the recording medium fed to the recording area and discharges the medium to the outside of the recording apparatus 1.

The recovery unit 9 performs recovery operations, such as maintenance and recovery of liquid ejection performance, for the recording head 3.

The recording apparatus 1 also includes as drive sources a first drive motor M1, a second drive motor M2, and a third drive motor (not shown). The driving force of the first drive motor M1 is provided to the carriage 2 through a transmission mechanism 4. This driving force causes the carriage 2 to move, while carrying the recording head 3, in directions indicated by the arrows A and B in FIG. 1.

The second drive motor M2, serving as another drive source, provides its driving force to the feed mechanism 5, the cassette-feed mechanism 6, and the recovery unit 9, which are driven units. The recording apparatus 1 also includes a transmission-switching mechanism 10 configured to switch between the feed mechanism 5, the cassette-feed mechanism 6, and the recovery unit 9 to set the target to which the driving force of the second drive motor M2 is transmitted. The third drive motor drives the conveyance mechanism 8.

In the recording apparatus 1, the recording medium is fed to the recording area by the feed mechanism 5 or the cassette-feed mechanism 6. While the recording medium is moved by the conveyance mechanism 8 by a predetermined length, the recording head 3 performs recording on the recording medium appropriately. Subsequently, the recording medium is discharged from the recording apparatus 1 by the conveyance mechanism 8. Thus, a series of recording operations ends.

A liquid storage unit 11, from which liquid is supplied to the recording head 3, is removably mounted on the carriage 2 carrying the recording head 3.

The recording head 3 has very small orifices through which liquid is ejected. The recording head 3 also includes a channel, an energy action site defined in a portion of the channel, and an ejection energy generator configured to generate energy for producing droplets of the liquid supplied to the energy action site and ejecting the droplets. Examples of the ejection energy generator include an electromechanical transducer, such as a piezoelectric element, and an electrothermal transducer, such as a heater element having an exothermic body. The electrothermal transducer heats and foams the liquid, thereby causing the liquid to be ejected through the orifices.

In a recording head configured to eject liquid by utilizing thermal energy, orifices through which the liquid is ejected can be arranged with a high density. Accordingly, a high-resolution image can be recorded on a recording medium. If an electrothermal transducer is employed as the energy generator, size reduction of the recording head and high-density assembly can be realized easily, and the manufacturing cost can be reduced.

The carriage 2 is connected to a portion of a drive belt 12 included in the transmission mechanism 4, and is supported by a guide rail 15 so as to be slidable therealong in a scanning direction (the directions A and B shown in FIG. 1). The carriage 2 reciprocates along the guide rail 15 in conjunction with the normal and reverse rotations of the first drive motor M1.

The body of the recording apparatus 1 is provided with a code strip 13 indicating the position of the carriage 2 moving in the directions A and B shown in FIG. 1. In the exemplary embodiment, the code strip 13 is a polyethylene-terephthalate (PET) film calibrated with black bars at a predetermined pitch. One end of the code strip 13 is bonded to a chassis 14, and the other end is supported by a spring (not shown).

The recording apparatus 1 includes a platen 16 facing the orifices of the recording head 3. The platen 16 serves as a table that supports the recording medium fed to the recording area. While the carriage 2 carrying the recording head 3 is caused to reciprocate by the driving force of the first drive motor M1, a recording signal is supplied to the recording head 3 and liquid is ejected from the recording head 3. Thus, recording is performed over the entire width of the recording medium conveyed onto the platen 16.

The conveyance mechanism 8 includes a conveyance roller 17. The conveyance roller 17 is driven by the third drive motor. The conveyance roller 17 is in contact with pinch rollers 18. The pinch rollers 18 are urged against the conveyance roller 17 by springs (not shown). The recording medium is conveyed while being nipped between the conveyance roller 17 and the pinch rollers 18. The pinch rollers 18 are rotatably supported by pinch-roller holders 19.

The conveyance roller 17 has at one end thereof a conveyance-roller gear 20. The rotational driving force of the third drive motor is transmitted to the conveyance-roller gear 20 through an intermediary gear (not shown), whereby the conveyance roller 17 is rotated.

The conveyance mechanism 8 also includes a discharge roller 22 and a discharge-roller gear 21. The discharge-roller gear 21 is secured to the discharge roller 22, by which the recording medium having an image formed by the recording head 3 is discharged to the outside of the recording apparatus 1. The discharge roller 22 is rotated when the rotation of the third drive motor is transmitted to the discharge-roller gear 21 through an intermediary gear (not shown).

The discharge roller 22 is in contact with a spur roller 23. The spur roller 23 is urged against the discharge roller 22 by a spring (not shown). The recording medium is discharged while being nipped between the discharge roller 22 and the spur roller 23. The spur roller 23 is rotatably supported by a spur-roller holder 24.

Figure 2:
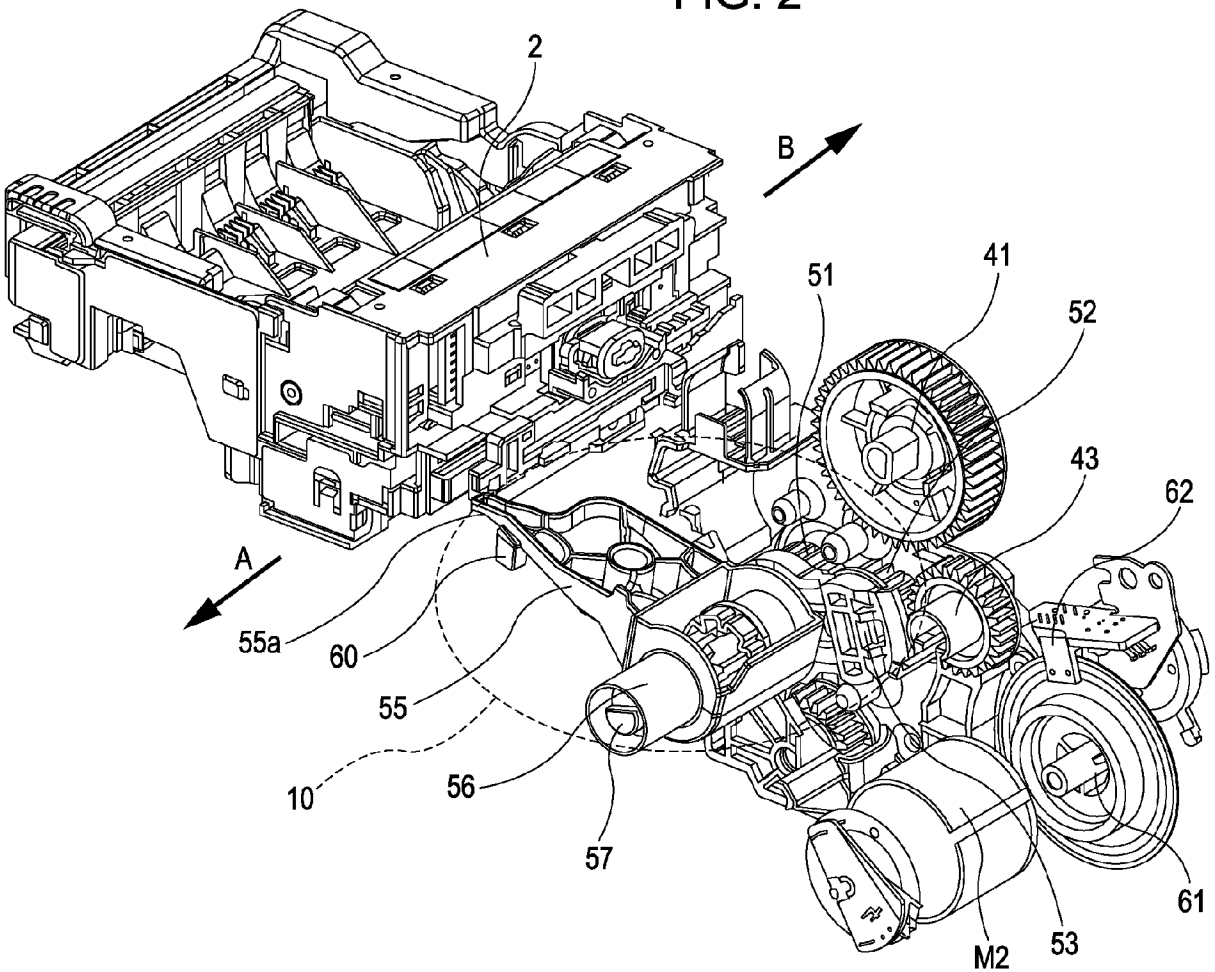
FIG. 2 is a schematic perspective view of a carriage, a transmission-switching mechanism, and relevant components provided therearound in the recording apparatus shown in FIG. 1.
Figure 3:
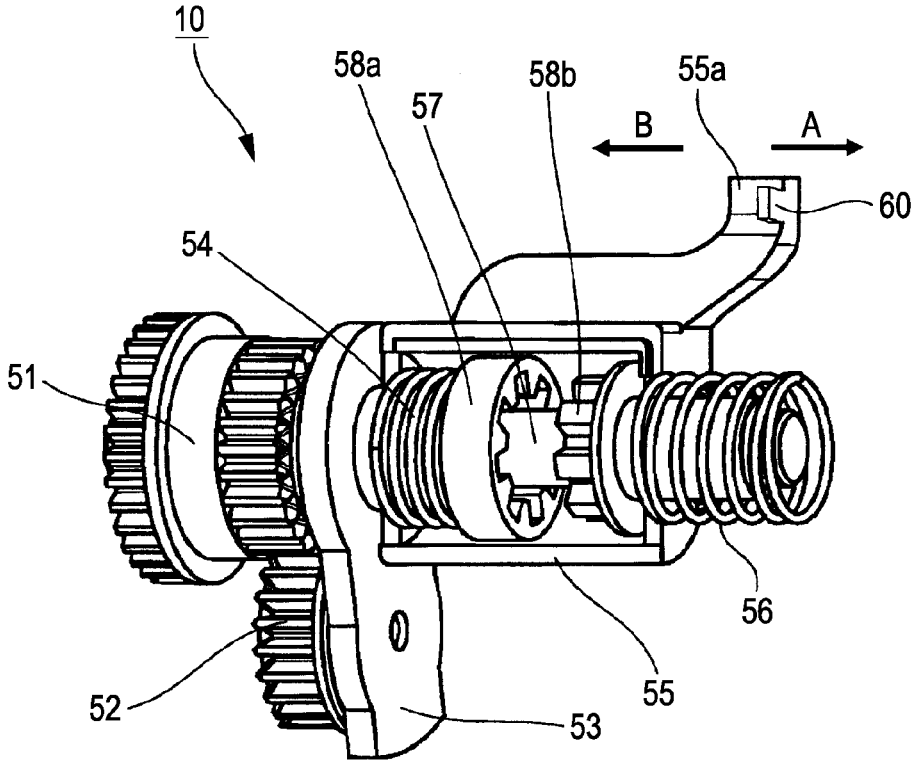
FIG. 3 is a schematic perspective view of the transmission-switching mechanism.

FIG. 2 is a schematic perspective view of the carriage 2, the transmission-switching mechanism 10, and relevant components provided therearound. FIG. 3 is a schematic perspective view of the transmission-switching mechanism 10.

The transmission-switching mechanism 10 includes a sun gear 51 and a planetary gear 52. A plurality of driving-force-input gears are provided around the transmission-switching mechanism 10. In the exemplary embodiment, the driving-force-input gears include a feed gear 41, a cassette-feed gear 42, and a recovery gear 43.

The feed gear 41 is connected to the feed mechanism 5, which is one of the driven units, and serves as a driving-force-input gear that transmits the driving force to the feed mechanism 5. The cassette-feed gear 42 is connected to the cassette-feed mechanism 6, which is another driven unit, and serves as another driving-force-input gear that transmits the driving force to the cassette-feed mechanism 6. The recovery gear 43 is connected to the recovery unit 9, which is yet another driven unit, and serves as a yet another driving-force-input gear that transmits the driving force to the recovery unit 9.

The sun gear 51 is rotatable. The driving force of the second drive motor M2 is transmitted to the sun gear 51 through a train of drive gears (not shown). This driving force causes the sun gear 51 to rotate.

A planetary-gear arm 53 serves as a support member and is rotatable about the center of rotation of the sun gear 51. The planetary gear 52 is supported by the planetary-gear arm 53 such that the planetary gear 52 can revolve around the sun gear 51. With the rotation of the planetary-gear arm 53, the planetary gear 52 revolves around the sun gear 51, whereby the driving-force-input gears can mesh with and be separated from the planetary gear 52.

The center of rotation of the sun gear 51 and the center of revolution of the planetary gear 52 coincide with each other, with a through shaft 57 extending therethrough. The through shaft 57 is provided with an output clutch 58*b*. The output clutch 58*b*, serving as an output rotor, rotates with the rotation of the sun gear 51. That is, the rotational force of the sun gear 51 is transmitted to the output clutch 58*b* through the through shaft 57.

The transmission-switching mechanism 10 also includes an input clutch 58*a* serving as an input rotor and facing the output clutch 58*b*. The input clutch 58*a* and the planetary-gear arm 53 are provided as an integral body. The input clutch 58*a* and the output clutch 58*b* are capable of meshing with each other at respective surfaces thereof facing each other. The input clutch 58*a*, having a cylindrical shape, has on the inner periphery thereof a plurality of inner teeth. The output clutch 58*b*, also having a cylindrical shape, has on the outer periphery thereof a plurality of outer teeth that are to mesh with the inner teeth of the input clutch 58*a*.

The planetary-gear arm 53, the planetary gear 52, and the input clutch 58*a* are supported by the through shaft 57 and are movable along the longitudinal direction of the through shaft 57, and together rotate about the through shaft 57 and move in the longitudinal direction of the through shaft 57. With the movement of the input clutch 58*a* in the longitudinal direction of the through shaft 57, the input clutch 58*a* and the output clutch 58*b* mesh with each other, or are connected to each other, and are separated, or are disconnected, from each other. The input clutch 58*a* and the output clutch 58*b* constitute a clutch that enables/disables the transmission of the driving force.

The transmission-switching mechanism 10 includes a clutch case 55 enclosing a portion of the through shaft 57. The input clutch 58*a*, the output clutch 58*b*, and a portion of the planetary-gear arm 53 are enclosed by the clutch case 55. The sun gear 51, the planetary-gear arm 53, the clutch case 55, and a clutch-case spring 56 are fitted in that order onto the through shaft 57. The clutch case 55 is urged against the planetary-gear arm 53 by the clutch-case spring 56.

A planetary-gear-arm spring 54 is provided inside the clutch case 55, between the input clutch 58*a* and the clutch case 55. The planetary-gear-arm spring 54 urges the clutch case 55 against the planetary-gear arm 53.

When no external forces are acting other than spring forces produced by the clutch-case spring 56 and the planetary-gear-arm spring 54, the planetary gear 52 is positioned so as to mesh with the sun gear 51, whereas the output clutch 58*b* and the input clutch 58*a* are separated from each other (the state shown in FIG. 3). This positional relationship is hereinafter referred to as the "planetary-gear-arm-fixed position". In the planetary-gear-arm-fixed position, rotation of the sun gear 51 causes the planetary gear 52 to rotate (on its own axis).

A clutch-case lever 55*a* (a lever) projects from the outer wall of the clutch case 55. The clutch-case lever 55*a* is provided with a movement-locking member 60 extending substantially perpendicularly to the direction in which the carriage 2 moves.

When the carriage 2 moves in one direction (the direction A shown in the drawings) and reaches an end in that direction, the carriage 2 comes into contact with the clutch-case lever 55*a* and causes the clutch case 55 to slide. The position of the carriage 2 at this end is defined as a clutch-operation position, corresponding to an end of a range through which the carriage 2 is movable. When the carriage 2 moves to the clutch-operation position, the carriage 2 causes the clutch case 55 to move in the one direction (the direction A shown in the drawings), which coincides with the longitudinal direction of the through shaft 57, against the urging force of the clutch-case spring 56.

When the clutch case 55 is pushed by the carriage 2 in the one direction, the entirety of the transmission-switching mechanism 10 is pushed in the direction in which the carriage 2 moves. Accordingly, the planetary gear 52 is also moved in the direction in which the carriage 2 moves, shifting to such a position as to be separated from the sun gear 51. In this state, the output clutch 58*b* and the input clutch 58*a* mesh with each other, enabling transmission of the driving force. This positional relationship is hereinafter referred to as the "planetary-gear-arm-rotation position".

In the planetary-gear-arm-rotation position, the output clutch 58*b* and the input clutch 58*a* mesh with each other. Therefore, the rotation of the sun gear 51 is transmitted to the input clutch 58*a* through the output clutch 58*b*. Thus, the input clutch 58*a* rotates, and the planetary gear 52 revolves about the through shaft 57.

As described above, when the transmission-switching mechanism 10 is pushed by the carriage 2 in the direction (the direction A) in which the carriage 2 moves, the planetary gear 52 revolves around an orbit. In this state, the direction of revolution of the planetary gear 52 can be changed by changing the direction of rotation of the second drive motor M2.

The angle of rotation of the second drive motor M2 is detected and controlled by a rotary encoder including a code wheel 61 and a second encoder 62. By controlling the rotation of the second drive motor M2 in this manner, the planetary-gear arm 53 and the planetary gear 52 can be positioned at any angle about the through shaft 57.

With the rotation of the planetary-gear arm 53, the planetary gear 52 can selectively mesh with any of the driving-force-input gears, namely, the feed gear 41, the cassette-feed gear 42, and the recovery gear 43. The planetary-gear arm 53 can also be positioned so as not to mesh with any of the driving-force-input gears. Thus, the transmission-switching mechanism 10 switches between the feed gear 41, the cassette-feed gear 42, and the recovery gear 43 to set the target to which the driving force of the second drive motor M2 is transmitted.

Hereinafter, for convenience of description, the states where the planetary gear 52 meshes with the feed gear 41, the cassette-feed gear 42, and the recovery gear 43 will be referred to as the "feed state", the "cassette-feed state", and the "head-recovery state", respectively. Further, the state where the planetary gear 52 meshes with none of the driving-force-input gears will be referred to as the "neutral state".

Figure 4:
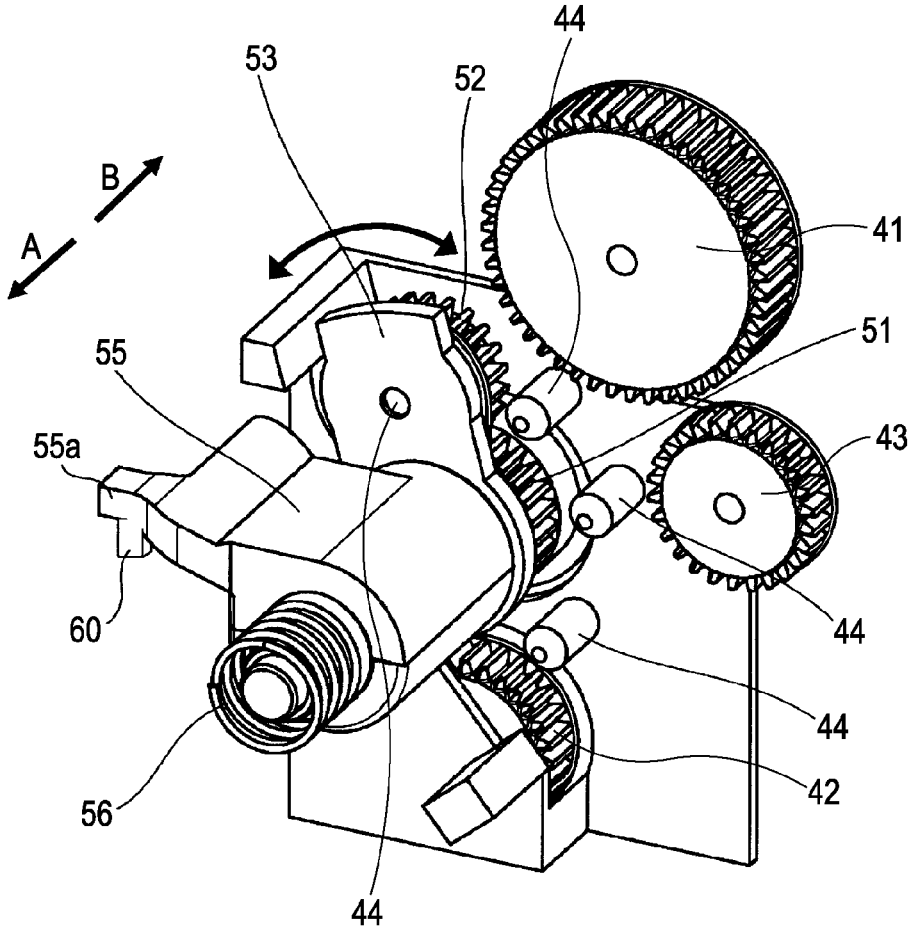
FIG. 4 is a schematic perspective view of the transmission-switching mechanism in a neutral state.
Figure 5:
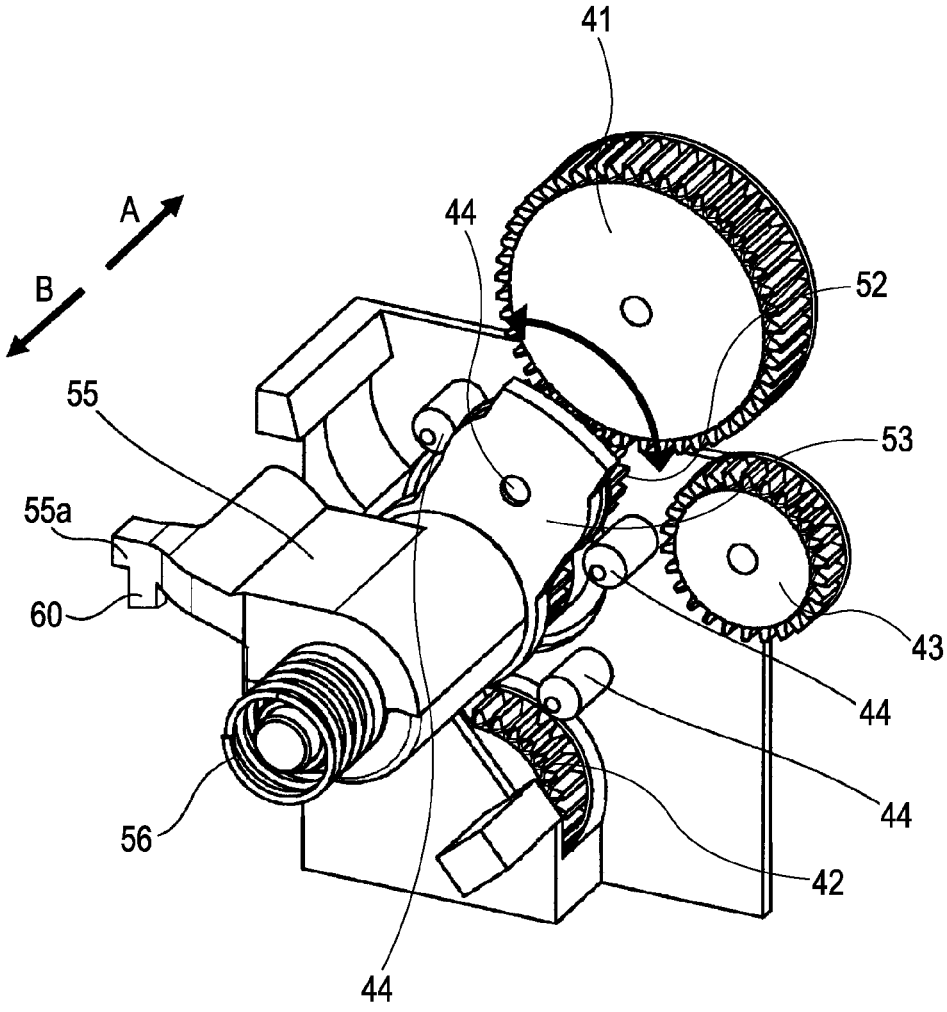
FIG. 5 is a schematic perspective view of the transmission-switching mechanism in a feed state.
Figure 6:
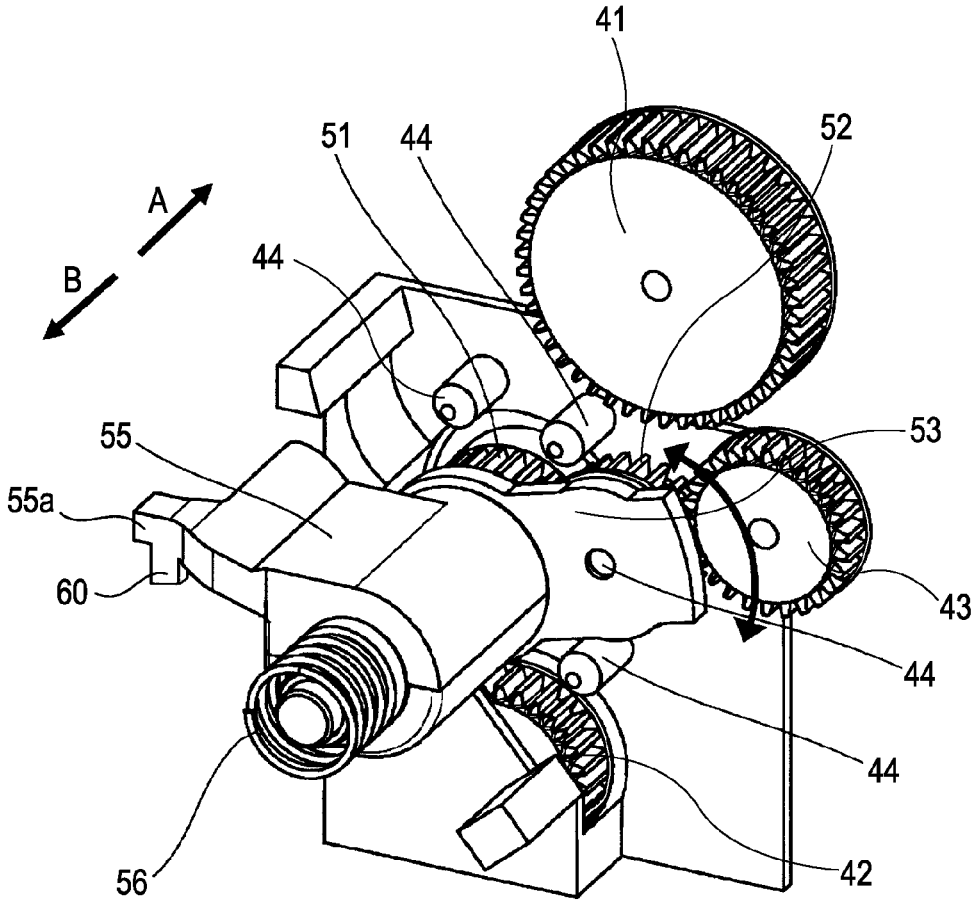
FIG. 6 is a schematic perspective view of the transmission-switching mechanism in a head-recovery state.
Figure 7:
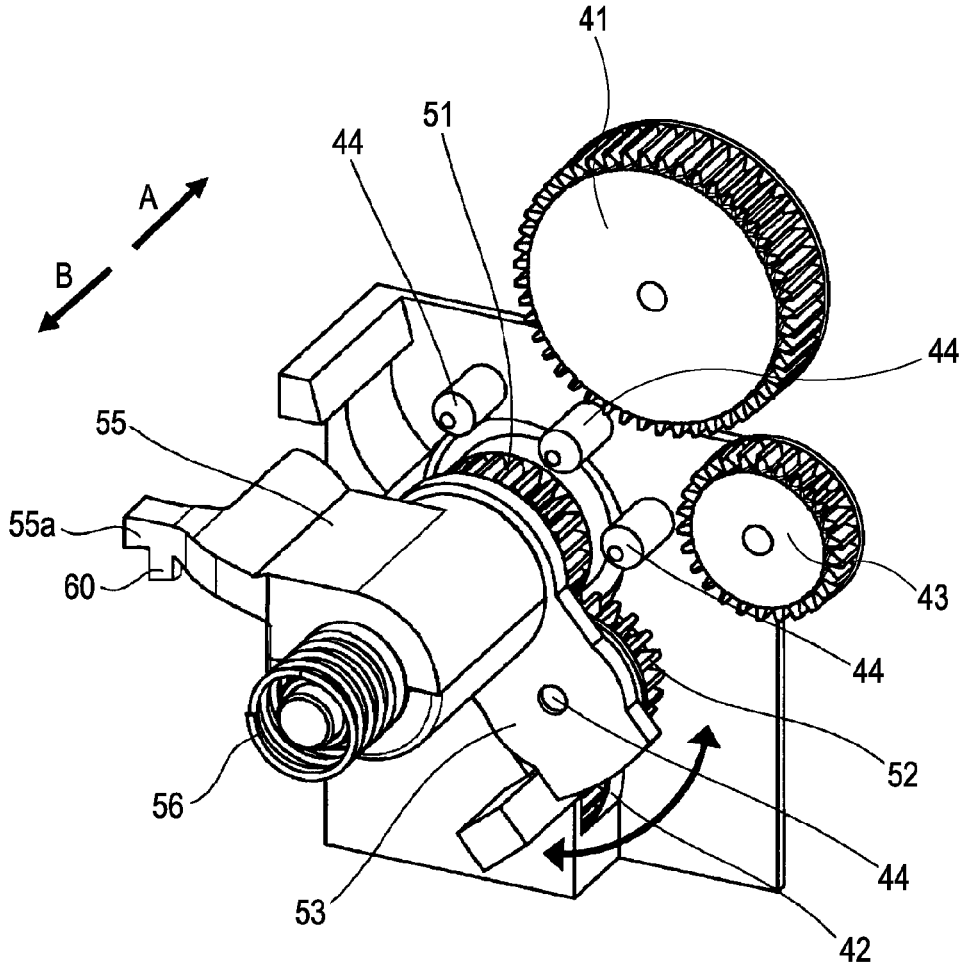
FIG. 7 is a schematic perspective view of the transmission-switching mechanism in a cassette-feed state.

Referring to FIGS. 4 to 7, the transmission-switching mechanism 10 in each of the foregoing states will now be described. FIG. 4 is a schematic perspective view of the transmission-switching mechanism 10 in the neutral state. FIG. 5 is a schematic perspective view of the transmission-switching mechanism 10 in the feed state. FIG. 6 is a schematic perspective view of the transmission-switching mechanism 10 in the head-recovery state. FIG. 7 is a schematic perspective view of the transmission-switching mechanism 10 in the cassette-feed state.

The driving-force-input gears, which are driven gears connected to the respective driven units included in the recording apparatus 1, are arranged around the orbit of the planetary gear 52. The driven units are driven by the drive source, i.e., the second drive motor M2.

The recording apparatus 1 includes a plurality of planetary-gear-arm-positioning pins 44 at positions where the planetary-gear arm 53 is positioned and fixed such that the driving-force-input gears selectively mesh with the planetary gear 52, including a position where none of the driving-force-input gears mesh with the planetary gear 52.

The driving force can be transmitted to any of the driving-force-input gears in the following manner. In each state where the planetary gear 52 mesh with the intended one of the driving-force-input gears, the planetary-gear arm 53 is positioned in the planetary-gear-arm-fixed position, and the planetary gear 52 is rotated. Thus, the intended one of the driven units is driven by the drive source producing a driving force.

In the planetary-gear-arm-fixed position, one of the planetary-gear-arm-positioning pins 44 is fitted in a depression provided in the planetary-gear arm 53, whereby the planetary-gear arm 53 is fixed so as not to rotate. In the planetary-gear-arm-rotation position, the planetary-gear arm 53 is spaced apart from the planetary-gear-arm-positioning pins 44 in the longitudinal direction of the planetary-gear-arm-positioning pin 44, whereby the planetary-gear arm 53 is allowed to rotate. The planetary-gear-arm-positioning pins 44 have such heights that the foregoing configuration is realized.

In the exemplary embodiment, four planetary-gear-arm-positioning pins 44 in total are provided so that four states that can be switched between are defined. The number of driving-force-input gears may be increased, if the space for providing relevant components permits, so that five or more states that can be switched between are defined. Alternatively, the transmission-switching mechanism 10 may switch between only two or three states.

The recovery unit 9 is provided at a position outside the range (the recording area) in which the carriage 2 carrying the recording head 3 reciprocates to perform recording. The recovery unit 9 maintains the liquid ejection performance of the recording head 3 and, if ejection failure occurs, recovers the recording head 3 from the failure.

Figure 8:
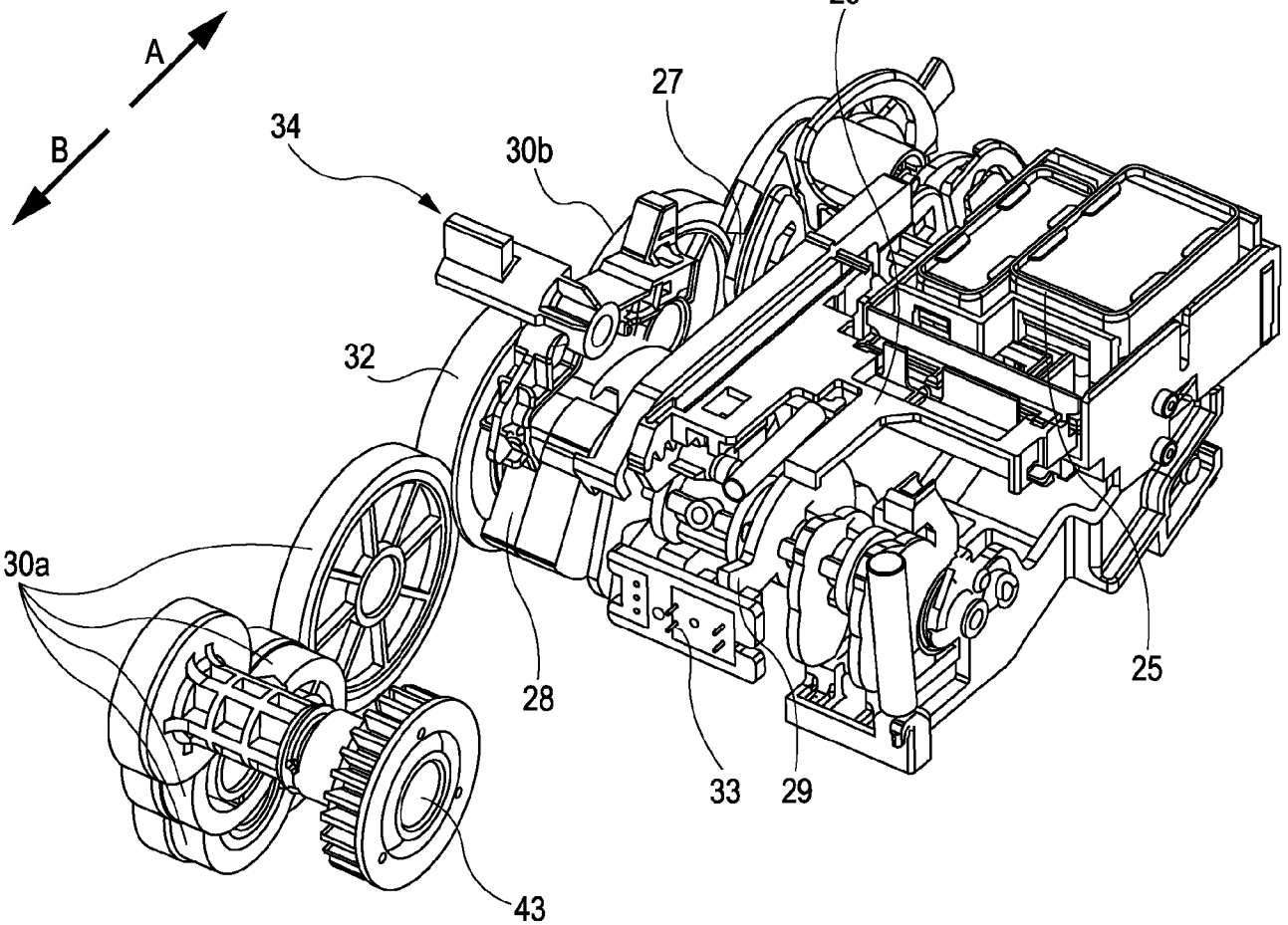
FIG. 8 is a schematic perspective view of a recovery unit included in the recording apparatus.

FIG. 8 is a schematic perspective view of the recovery unit 9. The recovery unit 9 includes a capping member 25 configured to cap a surface of the recording head 3 from which liquid is ejected (hereinafter referred to as the "ejection surface"), and a wiping member 26 configured to wipe (clean) the ejection surface of the recording head 3. The capping member 25 and the wiping member 26 are arranged between the clutch-operation position and the area through which the recording medium passes.

A suction unit 27 is connected to the capping member 25. When the suction unit 27 is driven in a state where the capping member 25 caps and seals the ejection surface of the recording head 3 (hereinafter referred to as the "capping state"), a recovery operation in which liquid is forcibly removed from the orifices is performed. By performing the recovery operation so as to remove liquid having an increased viscosity (for example, thickened ink) and bubbles in the orifices of the recording head 3, the liquid ejection performance of the recording head 3 is maintained or recovered. In addition, by capping the ejection surface of the recording head 3 when recording is not performed, the recording head 3 is protected, and the liquid therein is prevented from drying.

The wiping member 26 wipes off droplets, paper lint, and the like adhered to the ejection surface of the recording head 3. The wiping member 26 is provided near the capping member 25. The capping member 25, the wiping member 26, and the suction unit 27 in combination maintain the liquid ejection performance of the recording head 3 at a normal level.

Figure 9:
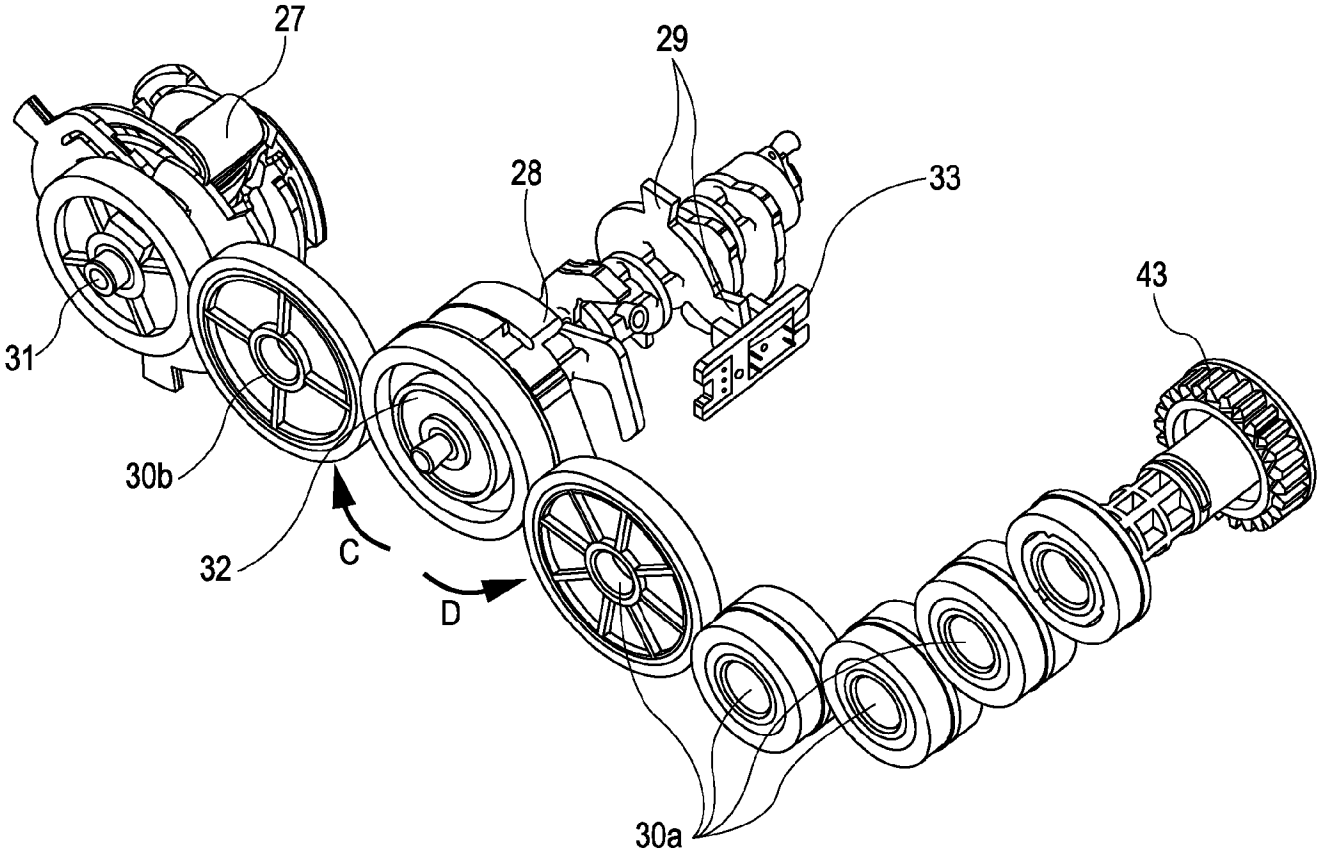
FIG. 9 is a schematic perspective view of trains of gears and a cam, serving in combination as a transmission mechanism, included in the recovery unit.

A mechanism that transmits the driving force to recovery-related components, including the capping member 25, the wiping member 26, and suction unit 27, will now be described with reference to FIG. 9. FIG. 9 is a schematic perspective view of the recovery unit 9 and relevant components provided therearound.

When the transmission-switching mechanism 10 is in the head-recovery state, the driving force of the second drive motor M2 is transmitted to the recovery gear 43. The driving force transmitted to the recovery gear 43 is further transmitted to a one-way transmitter 32 (a one-way-clutch gear) through a first intermediary gear 30*a*. The first intermediary gear 30*a* and a second intermediary gear 30*b*, described below, may each include a single gear or a plurality of gears, i.e., a train of gears.

The driving force of the second drive motor M2 is further transmitted to a pump gear 31 through the one-way transmitter 32 and the second intermediary gear 30*b*. When the pump gear 31 is driven to rotate, the suction unit 27, which is a pump, is activated.

The one-way transmitter 32 is provided with a cam 28 secured thereto. When the one-way transmitter 32 is rotated in one direction (a direction C shown in FIG. 9), the driving force is transmitted to the cam 28. In contrast, when the one-way transmitter 32 is rotated in the other direction (a direction D shown in FIG. 9), the cam 28 idles, that is, the driving force is not transmitted to the cam 28. In addition, when the one-way transmitter 32 is rotated in the other direction (the direction D shown in FIG. 9), the suction unit 27 is activated. Therefore, while suction is being applied by the suction unit 27, the driving force is not transmitted to the cam 28.

Figure 10:
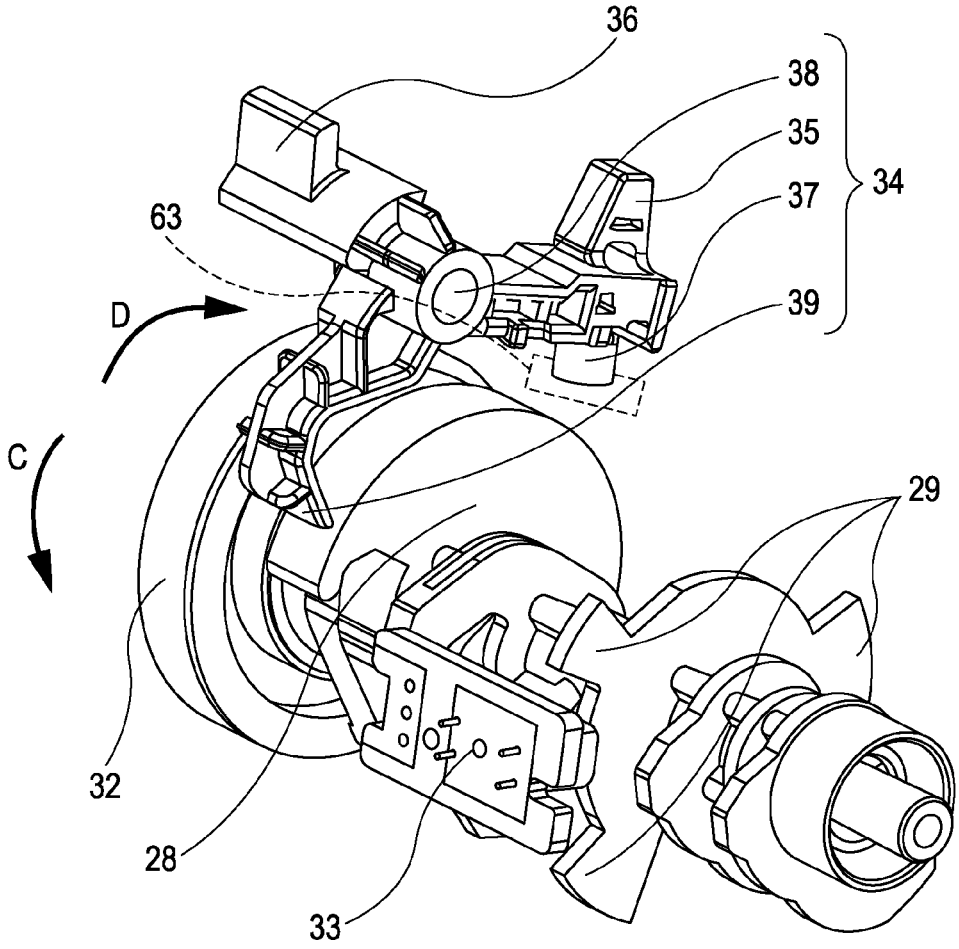
FIG. 10 is a schematic perspective view of a locking member and relevant components provided therearound in the recording apparatus.

FIG. 10 is a schematic perspective view of a locking member 34 included in the recording apparatus 1 of the exemplary embodiment and relevant components provided therearound. The locking member 34, serving as a locker, includes a carriage locker 35 that prevents and allows movement of the carriage 2, and a transmission-switching locker 36 that prevents and allows switching between the driven units. The locking member 34 is turnably provided on a shaft 38.

Figure 11A:
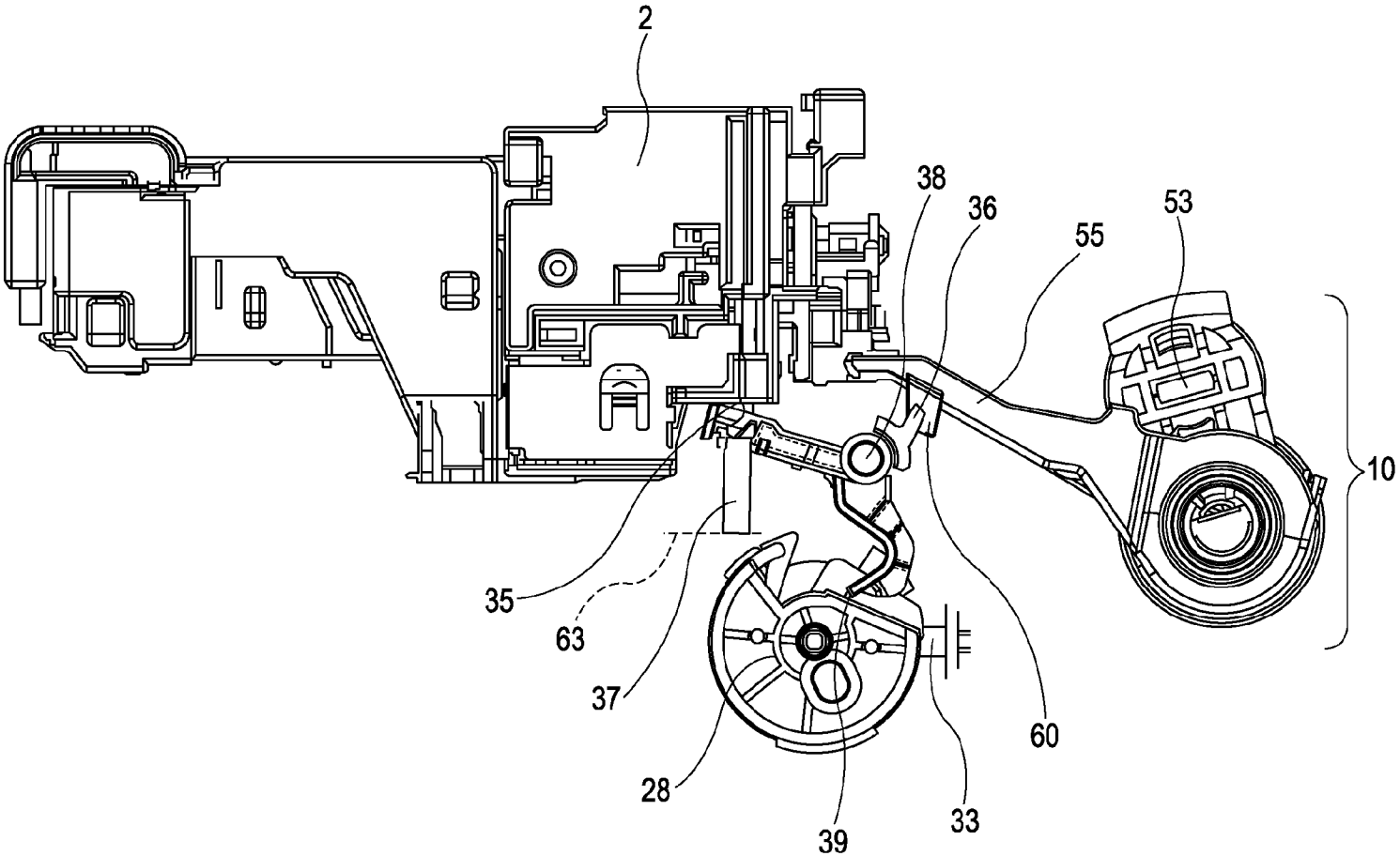
FIGS. 11A and 11B are schematic side views of the recording apparatus in a state where movements of the carriage and the transmission-switching mechanism are prevented and in a state where movements of the carriage and the transmission-switching mechanism are allowed, respectively.
Figure 11B:
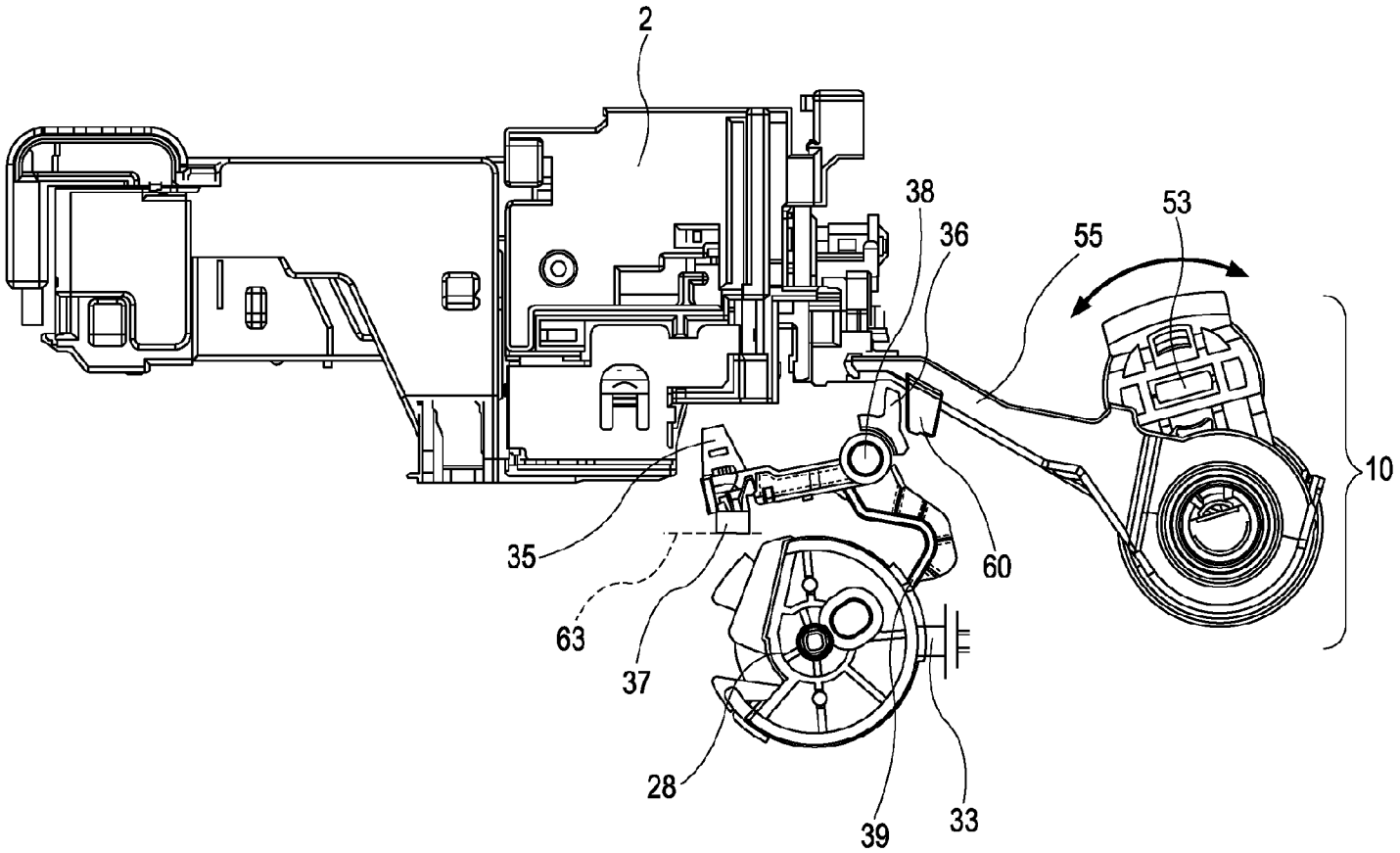

FIG. 11A is a schematic side view of the recording apparatus 1 in a state where movements of the carriage 2 and the transmission-switching mechanism 10 are prevented by the locking member 34. FIG. 11B is a schematic side view of the recording apparatus 1 in a state where movements of the carriage 2 and the transmission-switching mechanism 10 are allowed by the locking member 34.

The locking member 34 has a portion thereof being in contact with the cam 28, the portion being a contact portion 39. The locking member 34 has one end thereof serving as a locking spring 37. The locking spring 37 is secured to a fixed surface 63 of the body of the recording apparatus 1. The locking member 34 receives a resilient force from the locking spring 37. With this resilient force, the locking member 34 is urged in one turning direction about the shaft 38.

The contact portion 39 of the locking member 34 is pressed against the cam 28 by the foregoing resilient force. When the cam 28 rotates, the contact point between the cam 28 and the contact portion 39 (the distance from the center of rotation of the cam 28 to the contact point) changes, whereby the locking member 34 turns about the shaft 38. Thus, when the cam 28 is driven by the second drive motor M2, the locking member 34 is moved.

In the state where movement of the carriage 2 is prevented (as in FIG. 11A), the carriage locker 35 is fitted in a groove (not shown) provided in the carriage 2. Since the carriage locker 35 is in contact with the carriage 2, movement of the carriage 2 in the scanning direction (the directions A and B) is prevented.

In the state where movement of the carriage 2 is prevented, the transmission-switching locker 36 is positioned so as to prevent the transmission-switching mechanism 10 from sliding. Specifically, the transmission-switching locker 36 is in contact with one side face, in the direction in which the transmission-switching mechanism 10 slides, of the movement-locking member 60 of the clutch case 55, whereby the transmission-switching mechanism 10 is prevented from sliding.

The carriage locker 35 and the transmission-switching locker 36 are arranged at such positions that movements of the carriage 2 and the transmission-switching mechanism 10 are prevented simultaneously. Specifically, the recording apparatus 1 is configured such that the movement prevention by the carriage locker 35 and the movement prevention by the transmission-switching locker 36 are in synchronicity, and the movement allowance by the carriage locker 35 and the movement allowance by the transmission-switching locker 36 are in synchronicity.

When the locking member 34 is turned by rotating the cam 28 by a specific angle, movements of the carriage 2 and the transmission-switching mechanism 10 are allowed (as in FIG. 11B). In this state, the carriage locker 35 is retracted from the groove in the carriage 2, whereby movement of the carriage 2 is allowed. Further, the transmission-switching locker 36 is retracted from the movement-locking member 60 of the clutch case 55, whereby movement of the transmission-switching mechanism 10 is allowed.

As described above, while suction is being applied by the suction unit 27, the driving force is not transmitted to the cam 28. That is, movement of the carriage 2 and switching between the driven units are not allowed while suction is being applied. Moreover, by controlling the rotation angle of the cam 28, which is configured to be rotatable only in one direction, movement of the locking member 34 can be controlled.

The recording apparatus 1 according to the exemplary embodiment may include a rotation angle detector that detects the rotation angle of the cam 28. In such a case, the rotation angle of the cam 28 can be controlled easily. An example of the rotation angle detector employed in the exemplary embodiment will now be described.

Referring to FIG. 2, the rotation angle detector of the exemplary embodiment includes a detection cam on which a plurality of flags 29 having different lengths are provided, and the rotary encoder constituted by the code wheel 61 and the second encoder 62.

The rotation angle of the cam 28 is controlled and detected as follows. Referring to FIG. 9, a first encoder 33 is provided at a position where the flags 29 are expected to pass when the detection cam rotates. The first encoder 33 measures whether or not an infrared beam is transmitted, whereby whether or not any of the flags 29 reside at a position where the infrared beam is applied is detected.

The rotary encoder also detects the rotation angle of the second drive motor M2. The rotation angle of the second drive motor M2 is referred to in checking the length of the flag 29 residing at the position where the infrared beam is applied. In accordance with the length of the flag 29, the rotation angle of the cam 28 can be determined. Thus, the locking member 34 can be easily controlled between the states where movements of the carriage 2 and the transmission-switching mechanism 10 are prevented and allowed.

The foregoing control method is only exemplary, and another control method may be employed. For example, the recording apparatus 1 may include a rotary encoder that directly detects the rotation angle of the cam 28. Another possible embodiment is that a cam, in addition to the cam 28, is provided so as to control the vertical movement of the capping member 25 and the reciprocal movement of the wiping member 26.

In the recording apparatus 1 according to the exemplary embodiment, movement of the carriage 2 and switching by the transmission-switching mechanism 10 are prevented and allowed synchronously. This suppresses damage to and malfunction of the transmission-switching mechanism 10 due to significant vibration and impact that may be unintentionally given during transportation and in other situations.

The carriage locker 35 and the transmission-switching locker 36 are driven by a single drive-control unit, i.e., the second drive motor M2. Therefore, synchronous control of the carriage locker 35 and the transmission-switching locker 36 can be easily realized. Moreover, since the second drive motor M2 drives both the locking member 34 and the driven units, the configuration of the recording apparatus 1 becomes simplified.

In addition, since prevention and allowing of movements of the carriage 2 and the transmission-switching mechanism 10 are performed solely by the locking member 34, synchronicity therebetween can be obtained more precisely. Moreover, since the recording apparatus 1 includes a reduced number of components, the manufacturing cost can be reduced, the space can be saved, and the configuration of the recording apparatus 1 can be made much simpler.

The recording apparatus 1 according to the exemplary embodiment can be controlled such that movement of the carriage 2 and switching between the driven units are prevented in the capping state. Thus, the capping member 25 is prevented from coming off while suction is being applied to the liquid in the orifices of the recording head 3.

The recording apparatus 1 can also become the capping state when it is intended to prevent the liquid in the recording head 3 on the carriage 2 from drying or to protect the recording head 3 itself. In the capping state, movement of the carriage 2 and switching by the transmission-switching mechanism 10 can be prevented. In such a case, when recording is not performed, the recording apparatus 1 is in the capping state. That is, prevention of movement of the carriage 2 is performed frequently. In the recording apparatus 1 configured as above, prevention of movement of the carriage 2 is performed synchronously with prevention of switching between the driven units. Therefore, even if movement of the carriage 2 is prevented frequently, occurrence of malfunction of and damage to the transmission-switching mechanism 10 can be suppressed.

The locking member 34, which is constituted by a single member in the exemplary embodiment, may alternatively be constituted by a plurality of members. The locking member 34, which is driven by the second drive motor M2 in the exemplary embodiment, may alternatively be driven by another drive motor.

Meshing and unmeshing of the clutches 58*a* and 58*b*, which are realized by moving the input clutch 58*a* in the exemplary embodiment, may alternatively be realized by moving the output clutch 58*b*, or by moving both of the input clutch 58*a* and the output clutch 58*b*.

While the present invention has been described in detail with reference to exemplary embodiments, it is to be understood that the invention is not limited to the disclosed exemplary embodiments, and various changes and modifications can be made thereto without departing from the scope thereof.

What is claimed is:

1. A recording apparatus comprising:

a carriage carrying a recording head and being movably supported, the recording head being configured to eject liquid onto a recording medium;

a plurality of driven units to be driven by a drive source that generates a driving force;

a transmission-switching mechanism configured to switch between the driven units; and a transmission-switching prevention unit configured to prevent and allow switching between the driven units, wherein a portion of the transmission-switching mechanism is pushed by the carriage in a direction in which the carriage moves such that the portion is moved in the direction, whereby the transmission-switching mechanism is allowed to switch, and wherein the transmission-switching prevention unit contacts the portion to prevent moving in the direction.

2. The recording apparatus according to claim 1, wherein the transmission-switching prevention unit is controlled by a single drive-control unit.

3. The recording apparatus according to claim 2, wherein the drive source also serves as the drive-control unit.

4. The recording apparatus according to claim 1, wherein the transmission-switching prevention unit constitute a single preventing member.

5. The recording apparatus according to claim 4, wherein the preventing member is switchable between a state where the preventing member is in contact with the carriage and the transmission-switching mechanism so as to prevent the movement of the carriage and the switching between the driven units; and a state where the preventing member is retracted from the carriage and the transmission-switching mechanism so as to allow the movement of the carriage and the switching between the driven units.

6. The recording apparatus according to claim 5, further comprising a cam being in contact with a portion of the preventing member and configured to move the preventing member.

7. The recording apparatus according to claim 6, further comprising a rotation angle detector configured to detect a rotation angle of the cam.

8. The recording apparatus according to claim 1, further comprising:

a capping member configured to cap the recording head at an ejection surface thereof from which the liquid is ejected, wherein, in a capping state where the ejection surface is capped by the capping member, the transmission-switching prevention unit is controlled such that the switching between the driven units is prevented.

9. The recording apparatus according to claim 8, further comprising a suction unit configured to apply, in the capping state, suction to the liquid in the recording head, the suction unit being one of the driven units.

10. The recording apparatus according to claim 1, wherein the transmission-switching mechanism includes a planetary gear revolvable about an axis; and a plurality of driving-force-input gears arranged around an orbit of the planetary gear and capable of meshing with and separating from the planetary gear, and wherein the driving-force-input gears are each connected to a corresponding one of the driven units.

11. The recording apparatus according to claim 10, wherein the transmission-switching mechanism is pushed by the carriage in a direction in which the carriage moves, whereby the planetary gear revolves.

* * * * *